US005203716A

United States Patent [19]

Martucci et al.

[11] Patent Number: 5,203,716

[45] Date of Patent: Apr. 20, 1993

[54] TERMINAL BLOCK FOR PRINTED CIRCUIT BOARDS

[75] Inventors: Roberto Martucci; Mario Previato, both of Padua, Italy

[73] Assignee: Molex Incorporated, Lisle, Ill.

[21] Appl. No.: 896,937

[22] Filed: Jun. 11, 1992

[30] Foreign Application Priority Data

Jun. 14, 1991 [EP] European Pat. Off. ..... 91109788
May 8, 1992 [EP] European Pat. Off. ..... 92107809

[51] Int. Cl.[5] ..... H01R 4/24
[52] U.S. Cl. ..... 439/411; 439/791
[58] Field of Search ..... 439/409–419, 439/428, 801, 806, 807, 812, 813, 815, 790, 791

[56] References Cited

U.S. PATENT DOCUMENTS

| | | | |
|---|---|---|---|
| 3,039,074 | 6/1962 | Koenig | 439/412 |
| 3,163,482 | 12/1964 | Hubbell et al. | 439/412 |
| 4,040,701 | 8/1977 | Gressit | 439/412 |
| 4,391,484 | 7/1983 | Foederer | 339/97 P |
| 4,550,970 | 11/1985 | Ogino | 439/411 |
| 4,652,071 | 3/1987 | DeBortoli et al. | 339/99 R |
| 4,993,966 | 2/1991 | Levy | 439/411 |
| 5,096,437 | 3/1992 | Levy | 439/411 |
| 5,102,347 | 4/1992 | Cote et al. | 439/412 |

*Primary Examiner*—David L. Pirlot

*Attorney, Agent, or Firm*—A. A. Tirva

[57] ABSTRACT

A terminal block for receiving and terminating one or more conductors. The block comprises a housing of insulating material and screw-operated insulation displacement terminals (3) which are arranged in cavities (22) of the housing. Each terminal (3) includes a first contact member (4) which has an upper portion (5) containing a transverse opening (18) to accommodate one or more conductors. Furthermore, the first contact member (4) has a lower portion forming a downwardly extending pin (6) which extends through a base portion (14) of the housing and can be inserted into a plated-through hole of a printed circuit board. The terminal also includes a second contact member (7) forming a cage (8) which has on its top a threaded bore (11) for a screw (10). Furthermore, the second contact member (7) also has a transverse opening (17) which is aligned with the transverse opening of the first contact member when the upper portion (5) of the first contact member (4) is slidably mounted in the cage (8) of the second contact member (7). One of the transverse openings of the first and the second contact members (4, 7) is provided with at least one insulation displacement slot (20). When the screw is rotated, the transverse openings (17, 18) are forced out of alignment such that the conductors are forced into the insulation displacement slots (20).

7 Claims, 2 Drawing Sheets

TERMINAL BLOCK FOR PRINTED CIRCUIT BOARDS

FIELD OF THE INVENTION

This invention generally relates to the art of electrical connectors and, more particularly, to a terminal block for connecting insulated wires to conductive traces of a printed circuit board, the terminal block comprising a housing of insulating material and screw-operated insulation displacement terminals for terminating one or more conductors without stripping the insulation from the wires.

BACKGROUND OF THE INVENTION

Terminal blocks exist for terminating one or more conductors to a multi-conductor cable, typically comprising a housing of insulating material and screw-operated insulation displacement terminals positioned in cavities of the housing.

An example of a terminal block of that kind is disclosed in U.S. Pat. No. 4,993,966. The terminal block is used for connecting pairs of drop wires to pairs of conductors of a multi-conductor cable, for instance a telephone cable. The connector block comprises a housing having a plurality of apertures therethrough. Individual terminal modules may be inserted into each aperture of the housing in different orientations so that the drop wires can be connected from different directions. Each module has two insulation displacement terminals having slots into which the pairs of insulated drop wires are forced by means of a screw such that the terminals make contact with the conductors of each wire. The opposite ends of the terminals are connected in a conventional manner to pairs of conductors of the multi-conductor cable.

A further example of a known terminal block connecting local cable conductors to a telephone distribution cable is disclosed in U.S. Pat. No. 4,652,071. The block has insulation displacement terminals inserted into a plurality of recesses of an elongated body of insulating material. Connector members are forced into the recesses by a screw mounted in each connector member. To establish contact between an insulated conductor and a terminal, the conductor is inserted into a transverse bore of the connector member which when pushed down by rotating the screw allows the terminal to enter the member and make contact with the conductive core of the conductor. The other ends of the terminals are connected in a conventional manner to the cable conductors.

The connector blocks of the above-identified patents are intended for connecting conductors or wires to one another. They cannot be used for making connection to the conductive traces of printed circuit boards. The insulation displacement terminals of the known terminal blocks each consists of many complicated parts and do not allow for accommodation of more than one conductor. To connect two or more conductors to one terminal, however, is often necessary in establishing connections to printed circuit boards. Prior known terminal blocks for printed circuit boards using screws for clamping the conductive cores of conductors accommodate more than one conductor, but the insulation of the conductors must be stripped off before inserting them into the terminals.

Accordingly, this invention is directed to a terminal block for establishing a connection between multiple conductors and a printed circuit board using insulation displacement terminals which therefore eliminate the need to strip the insulation from the conductor. Furthermore, the terminal block according to the invention has a minimum number of parts with consequent low cost and simple assembly.

In connecting more than one insulated conductor to each terminal, the invention provides that each terminal comprises a first contact member and a second contact member. The first contact member has an upper portion including a transverse opening to accommodate one or more conductors, and a lower portion forming a downwardly extending pin extending through a base portion of an insulative housing and adapted to be inserted in a plated through hole printed circuit board. The second contact member forms a cage which has on its top a threaded bore adapted to accept a screw. The cage has a transverse opening which is adapted to be aligned with the transverse opening of the first contact member when the upper portion of the first contact member is slidably mounted in the second contact member. One of the transverse openings of the first and the second contact member has at least one insulation displacement slot. The screw of the second contact member rests with its end on the upper portion of the first contact member and when rotated forces the openings of the first and the second contact members out of alignment such that the conductors are forced into the insulation displacement slots.

Accordingly the terminals each have only three parts, namely the two contact members and the screw. Any desired number of terminals can be inserted into the base portion of the housing to form a block or module.

When the screw is rotated, the conductors inserted into the transverse openings of the two contact members are each forced into an insulation displacement slot where a secure mechanical and electrical connection is made between the contact members at the edges of the displacement slots and the conductive cores of the conductors.

The insulative housing may include a cover having cavities each for accommodating one terminal and being connectable to the base portion of the housing. Each cavity is provided with a transverse opening formed in one of its sidewalls each opening being aligned with the transverse openings of the first and the second contact members for receiving the conductors. Each cavity further includes an openings on top for accessing the screw. The cover preferably consists of a transparent plastic material such that the terminated conductors may be seen.

Advantageously, the cage-like structure of the second contact member may be formed from a folded metal strip, having end portions spaced apart for slidably accommodating the upper portion of the first contact member. The transverse opening of the first contact member is provided with at least one insulation displacement slot which extends from the opening in an upward direction. The insulation displacement slots may also be provided in the second contact member extending from its transverse opening in a downward direction. It would also be possible to provide both the first and second contact members with insulation displacement slots. If the first contact member is provided with the slots, the electrical resistance between the conductors and the printed circuit board is at a minimum.

One of the walls of the second contact member adjacent the wall containing the transverse opening may be formed so as to provide a horizontal guide surface aligned with the transverse openings of the first and the second contact members and the sidewall openings of the cover for securely guiding the conductors into the openings of the contact members.

While the housing may comprise any number of cavities, a module including two cavities each accommodating one terminal is of advantage in the practice. Several modules of that kind can be arranged side by side on a printed circuit board.

BRIEF DESCRIPTION OF THE DRAWINGS

A preferred embodiment of the invention is described by referring to the drawings in which.

DETAILED DESCRIPTION OF THE PREFERRED EMBODIMENT

Figure 1:
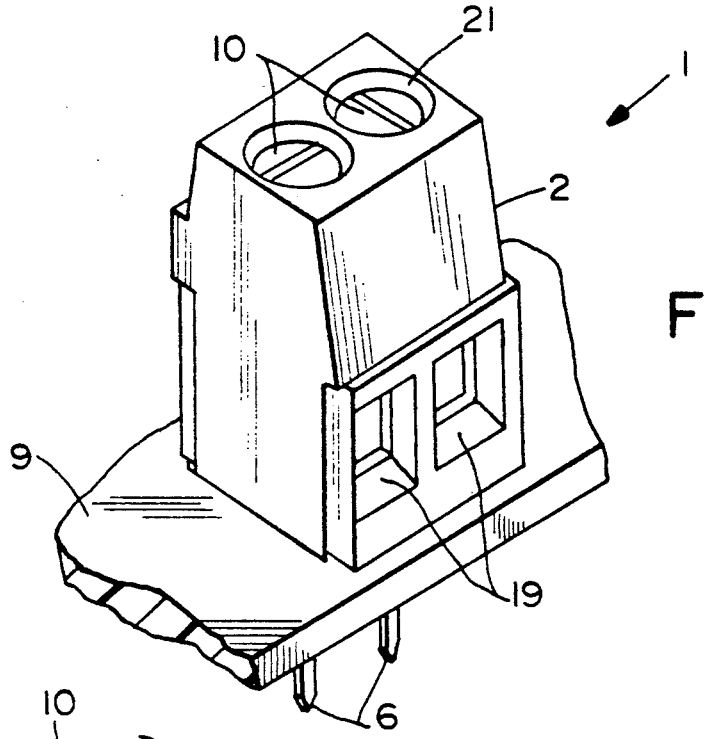
FIG. 1 is a perspective view of the embodiment of the invention.
Figure 2:
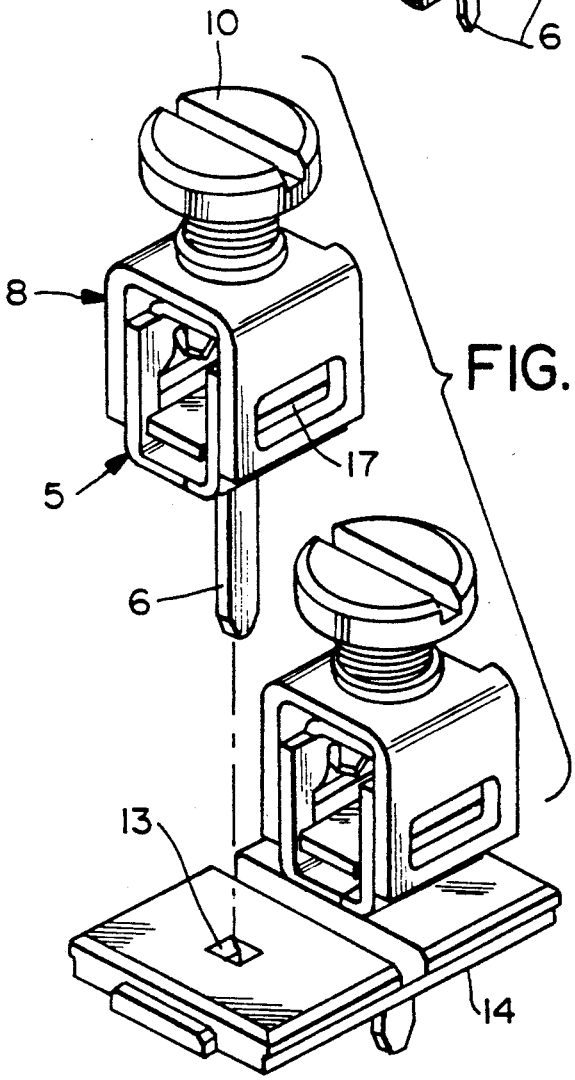
FIG. 2 shows the embodiment of FIG. 1 without the cover of the housing and with one terminal not yet assembled.

The embodiment of the invention illustrated in the drawings is a terminal block generally denoted 1 in FIG. 1. In a housing 2 of plastic material, for instance polyamide, there are accommodated two terminals which are generally denoted 3 in FIG. 2. By means of terminals 3 insulated conductors 23 can be connected to a printed circuit board 9. Terminals 3 include a first contact member 4 having an upper portion 5 and a lower portion 6 in the form of a pin. The first contact member 4 is inserted into a second contact member 7 with a cage-like portion 8. Both contact members 4, 7 are formed of folded metal strips. The metal strip of the second contact member 7 is formed such that the ends are spaced apart at a distance to allow the first contact member 4 to be slidably mounted therein. A screw 10 is inserted in a threaded bore 11 of the second contact member 7. The flat end 12 of screw 10 rests on the top surface of the upper portion 5 of the first contact member 4.

When assembling the terminal block, terminals 3 are inserted with their pins 6 in apertures 13 (see FIG. 2) in a base member 14 which also consists of plastic material, for instance polyamide. Finally, cover 24, which is provided with cavities 22 for receiving terminals 3, is pressed onto base member 14 and snapped-in with a ridge 15 at the bottom of housing 2 engaging a mating recess 16 of base member 14. Cover 24 of housing 2 includes top openings 21 through which screws 10 may be rotated by means of a conventional screwdriver.

The terminal block 1 is attached to a printed circuit board 9 by inserting pins 6 of terminals 7 into the apertures of the printed circuit board. After soldering pins 6 to the conductive traces of a printed circuit board plated-through hole, terminal block 1 is firmly held in its position. Simultaneously a good electrical contact is made with the first contact members 4.

Figure 4:
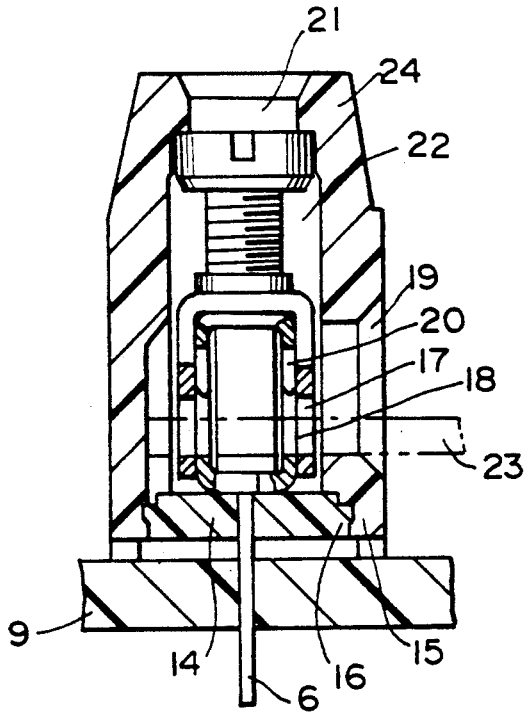
FIG. 4 is a cross-sectional view of the embodiment according to FIG. 1 along sectional line 4—4 in FIG. 5.

The normal position of terminals 3, i.e. the position in which screw 10 is in its utmost position, is shown in FIG. 4. The second contact member 7 is in its lowermost position and rests with its top on the upper surface of portion 5 of contact member 4. In this position transverse openings 17 of second contact member 7 and transverse opening 18 of first contact member 4 are aligned so that conductors 23 can be pushed through a lateral opening 19 of cover 24 and through openings 17 and 18.

Figure 6:
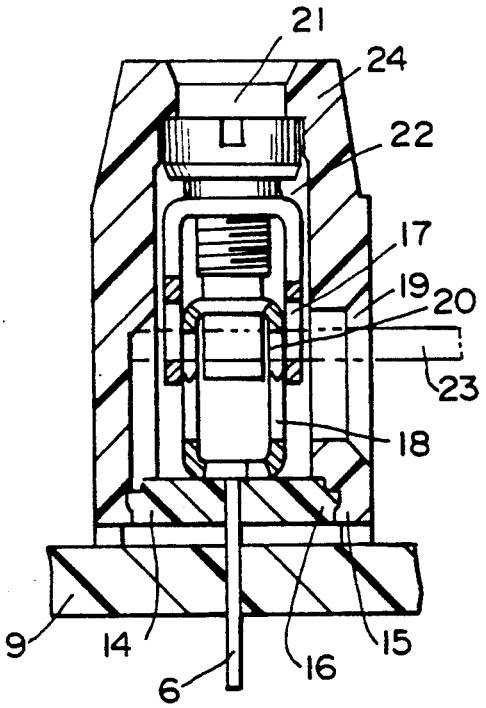
FIG. 6 is a sectional view similar to FIG. 4, but after operation of the terminal.

For securing the insulated conductors to the terminal block and making electrical contact between the conductive core of the conductors and contact members 4, 7, screw 10 is rotated such that second contact member 7 is forced by the flat end 12 of screw 10 in an upward direction as shown in FIG. 6. Simultaneously the conductors resting in transverse openings 17, 18 are also forced in an upward direction into slots 20 which extend upwardly from opening 18. The widths of slots 20 is selected in such a manner that the insulation of the conductors is cut and a reliable low resistance contact is made between the edges of slots 20 and the conductive core of the conductors.

Figure 5:
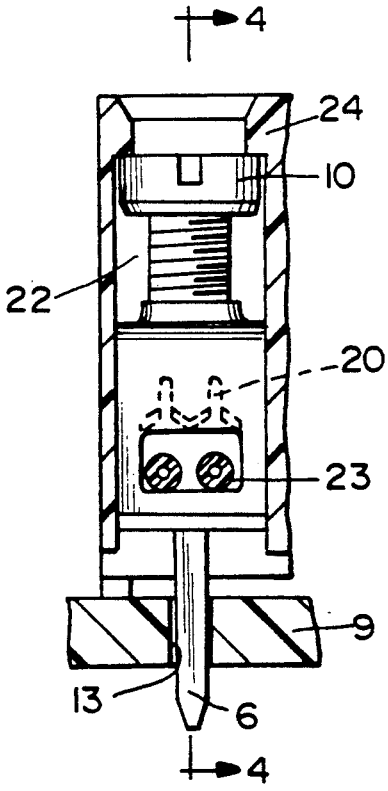
FIG. 5 is a side elevation view of a part of the embodiment according to FIG. 1.
Figure 3:
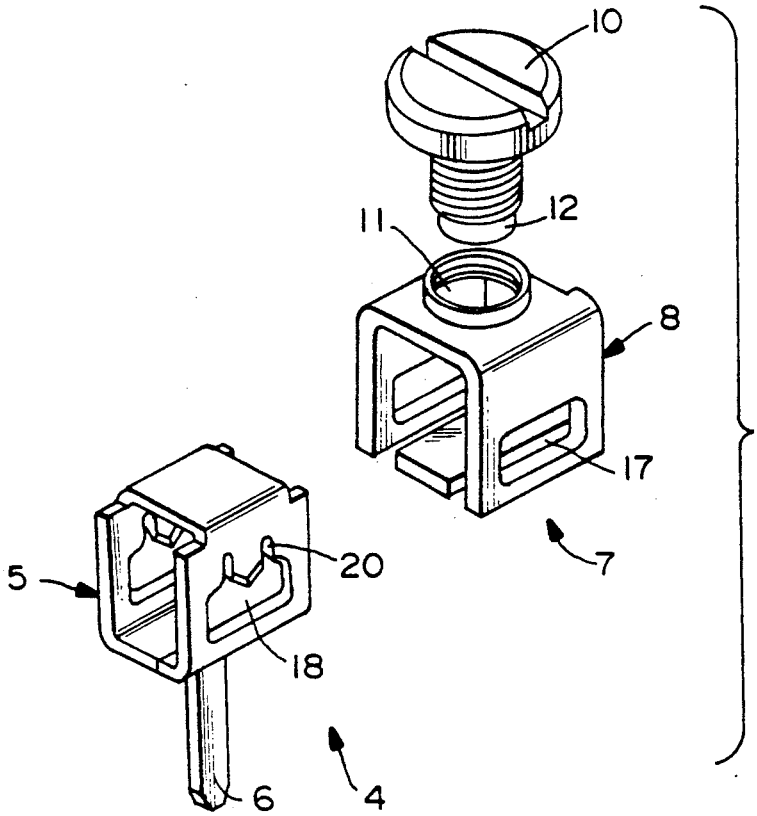
FIG. 3 shows the parts of a terminal according to FIG. 2.

As shown in the drawings and particularly in FIG. 5 first contact member 4 is provided with two slots 20 such that one or two conductors may be connected. It is possible however to provide for more than two slots. For guiding the conductors into openings 17, 18 second contact member 7 is provided with a horizontal guiding surface 21 formed from a wall adjacent the wall in which is formed the transverse opening 17. Alternatively, a guide surface may be formed or molded on base member 14.

It will be understood that the invention may be embodied in other specific forms without departing from the spirit or central characteristics thereof. The present examples and embodiments, therefore, are to be considered as illustrative and not restrictive, and the invention is not to be limited to the details given herein.

We claim:

1. A terminal block for establishing a connection between one or more conductors and a printed circuit board having a housing (2) of insulating material and screw-operated insulation displacement terminals (3) received in cavities (22) of the housing, the improvement in said terminal block comprising:

each of said terminals (3) includes a first contact member (4) having an upper portion (5) containing a transverse opening (18) to accommodate one or more conductors, the first contact member (4) further having a lower portion (6) forming a downwardly extending pin, each terminal (3) further including a second contact member (7) forming a cage (8) which has on a top thereof a threaded bore (10) adapted to accept a screw (10), and a transverse opening (17), the upper portion (5) of the first contact member (4) being slidably mounted in the cage (8) of the second contact member (7) with the transverse openings (17, 18) of the first and second contact members (4, 7) being aligned, the pin (6) of the first contact member (4) extending through a base portion (14) of the housing (2) and being adapted for insertion into a plated-through hole of a printed circuit board, one of the transverse openings (17, 18) of the first and the second contact members (4, 7) having at least one insulation displacement slot (20), and the screw (10) resting with its end (12) on the upper portion (5) of the first contact member (4) and when rotated forcing the transverse openings (17, 18) of the first and second contact members (4, 7) out of alignment such that the conductors are forced into the insulation displacement slots (20).

2. A terminal block according to claim 1 wherein said housing (2) comprises a cover (24) having cavities (22) each for accommodating one terminal (3) and being connectable to the base portion (14) of the housing, the cover (24) further having openings (19) in one of its sidewalls aligned with the transverse openings (17,18) of the first and the second contact members (4, 7) for receiving the conductor or conductors respectively and openings (21) on top for accessing the screws (10).

3. A terminal block according to claims 1 or 2 wherein the cover (24) consists of transparent plastic material.

4. A terminal block according to claim 1 wherein the case of the second contact member (7) is formed of folded metal strips, the end portions being spaced apart for slidably accommodating the upper portion (5) of the first contact member (4).

5. A terminal block according to claim 4 wherein the transverse opening (18) of the first contact member (4) is provided with the at least one insulation displacement slot (20) which extends from the transverse opening (18) in an upward direction.

6. A terminal block according to claim 1 wherein the second contact member includes a horizontal guide surface aligned with the openings (17, 18) of the first and the second contact members (4, 7) and sidewall openings (19) of the cover (2) for guiding the conductors into the openings (17, 18) of the contact members.

7. A terminal block according to claim 1 wherein the housing (2) includes two cavities (22) each for accommodating one terminal (3).

* * * * *